United States Patent [19]

Ross et al.

[11] Patent Number: 4,687,248

[45] Date of Patent: Aug. 18, 1987

[54] CONVERTIBLE LOUNGE CHAIR/TOTE BAG

[75] Inventors: Richard S. Ross, Miami; John E. Friedman; James A. Friedman, both of North Miami Beach, all of Fla.

[73] Assignee: Tri-Rel, Inc., North Miami Beach, Fla.

[21] Appl. No.: 909,294

[22] Filed: Sep. 19, 1986

Related U.S. Application Data

[63] Continuation of Ser. No. 748,328, Jun. 24, 1985, abandoned.

[51] Int. Cl.[4] ..... A45F 4/00; A47C 13/00

[52] U.S. Cl. ..... 297/129; 5/67; 190/2; 190/8; 297/17; 297/188; 383/4

[58] Field of Search ..... 297/17, 118, 129, 188; 5/82 R, 67, 442, 417; 224/151, 155, 156; 383/4; 190/8

[56] References Cited

U.S. PATENT DOCUMENTS

| | | | |
|---|---|---|---|
| 2,490,367 | 12/1949 | Maddocks | 190/8 |
| 2,819,776 | 1/1958 | Balsam | 383/4 X |
| 2,915,154 | 12/1959 | Holder | 297/17 X |
| 3,309,134 | 3/1967 | Roberts | 190/8 X |
| 3,404,915 | 10/1968 | De Souza Filho | 297/17 |
| 3,879,775 | 4/1975 | Iwata | 5/442 |
| 3,947,903 | 4/1976 | Menke | 297/188 |
| 4,273,221 | 6/1981 | Poag | 190/8 |
| 4,518,198 | 5/1985 | Daniels | 297/118 X |

FOREIGN PATENT DOCUMENTS

| | | | |
|---|---|---|---|
| 839252 | 5/1952 | Fed. Rep. of Germany | 190/8 |

*Primary Examiner*—Kenneth J. Dorner
*Assistant Examiner*—Peter R. Brown

[57] ABSTRACT

A convertible lounge chair-tote bag is disclosed which provides for a container carrying tote bag which can be converted into a lounge chair. This is accomplished by having the sides of the bag in releasable relation to the sides of the back and leg support, respectively.

5 Claims, 6 Drawing Figures

CONVERTIBLE LOUNGE CHAIR/TOTE BAG

This is a continuation of application Ser. No. 748,328, filed June 24, 1985, now abandoned.

FIELD OF THE INVENTION

This invention relates to a lounge chair. More specifically, this invention relates to a lounge chair which can be converted and formed from itself into a tote bag.

BACKGROUND OF THE INVENTION

There are many types of lounge chairs available and common to the marketplace. There are indoor lounge chairs and outdoor lounge chairs. There are permanent-structured chairs and lounge chairs which can be folded into several sections. Portable lounge chairs are taken to different places. These places might be located by the water such as a beach or lakefront property. Also, these lounge chairs are used at campsites. Additionally, these lounge chairs can be used where one resides.

The transportation of these foldable portable lounge chairs by individuals has encompassed many problems. First, these chairs are very cumbersome to carry and difficult to hold. The difficulty lies in the unbalanced weight of the lounge chair when it is in the folded position. Another difficulty arises when the lounge chair is folded; the back support and leg support of the lounge chair tend to open when carried to the unfolded position.

Further disadvantages of the prior art are encountered when people desire to go places where it is necessary to bring numerous other articles in addition to their desire to bring a lounge chair. For example, when one goes to the beach, one oftentimes desires to bring with him or her beach amenities other than a beach lounge chair such as a beach blanket, a beach towel, a radio, sun tan lotions or oils, money, additional dry clothing, keys, and edibles. It is very difficult for one to carry all of these amenities while also carrying a beach lounge chair. At best, both hands are utilized in carrying such desired accoutrements leaving the holder vulnerable should he or she require the emergency use of an arm or hand and at worst, many of these items are dropped by the holder simply because they ae too numerous for one person to carry. This is exemplified by the young mother who wishes to go to the beach with her child; she needs to bring all of the child's requirements such as spare diapers, baby formula, baby clothing, towels, and other baby needs while desiring to bring a lounge chair for self-comfort.

Likewise is true for those who desire to go camping, to the park, an outdoor concert, or any other event where one desires to sit in a lounge chair while bringing a multitude of other items with him or her.

Further, tote bags are numerous in the public domain. However, and quite obviously, tote bags cannot be used as lounge chairs.

SUMMARY OF THE INVENTION

A convertible lounge chair-tote bag as is embodied in the present invention transcends the above-mentioned difficulties by providing a container carrying tote bag that can convert into a lounge chair. This is accomplished by having the sides of the bag in releasable relation to the sides of the back and leg support, respectively.

For example, when the mother above goes to the beach with her child, she simply used the tote bag form of the present invention and introduces into the tote bag all of the items necessary for the child's needs. A hand strap or shoulder strap means for carrying the device makes it easy for the mother to carry her baby while leaving her other hand totally free for any emergency that arises.

Beach goers would no longer be encumbered by all of the beach going accoutrements. All of the items can be placed into the tote bag form and when one arrives at the beach, the items can be removed from the tote bag and the tote bag is then converted into the lounge chair thus allowing the beach goer a comfortable and convenient place to sit.

Another advantage of the present invention provides for a shoulder strap attached to the convertible lounge chair-tote bag. When the invention is in its tote bag form, the shoulder strap allows for both hands to remain free.

Still another advantage of the present invention allows for a balanced foldable lounge chair-tote bag when the invention is in its tote bag form. This feature allows one to transport or carry the invention.

BRIEF DESCRIPTION OF THE DRAWINGS

The features embodying the present invention are illustrated in the accompanying drawing, forming a part of this application, in which.

DETAILED DESCRIPTION OF A PREFERRED EMBODIMENT

Figure 1:
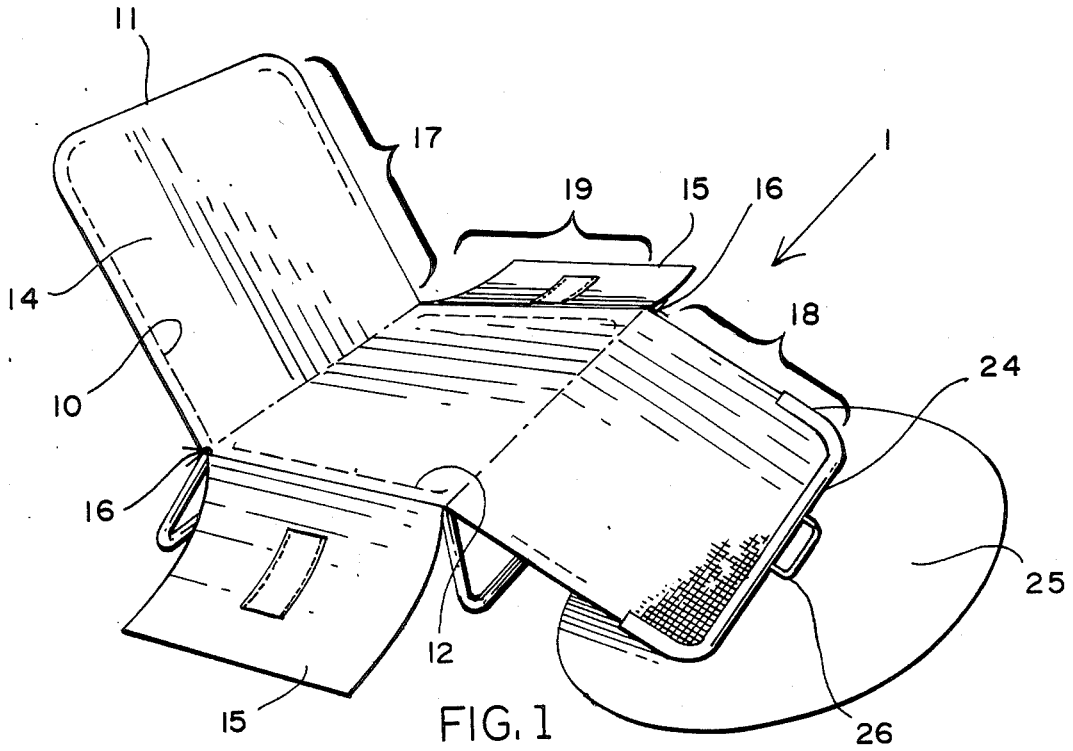
FIG. 1 is a perspective view of the lounge chair formation of the present invention in the ready-to-sit position.

A detailed description of a preferred embodiment is shown in FIG. 1. Therein, lounge chair 1 is viewed in a conventionally open position. Side support bar 10 and end support bar 11 (shown without head rest 22) which are preferably, one piece of lightweight metal such as aluminum, are affixed to base support bar 12 via the support hinge's 16 metal extrusions 33 by crimping or other affixing means. The support hinge 16 provides for multi-angulation engagement of the back support 17 and the leg support 18 such that the back support 17 and leg support 18 can be positioned at least in a 180° opposed direction with regard to one another and the base support 19. Therefore, the support hinge 16 is capable of multi-angulation engagement at degrees from approximately 0° to approximately 180°. Further, the support hinge 16 is capable of disengaging itself at a degree less than approximately 90° such that either the back support 17 or leg support 18 can be approximately parallel with the base support 19. Such a hinge is conventional and part of the prior art.

Affixed to the lounge chair 1 and more specifically the back support 17, leg support 18, and base support 19 is a cover material 14. Such cover material may be either a natural cloth or polysynthetic material wherein such material is continuous throughout the lounge chair 1. This cover material 14 will be affixed to the end support bar 11, side support bar 10, and base support bar 12. Examples of such affixing means may be made by either conventional sewing with needle and thread or a durable adhesion, for example, glue.

The cover flaps 15 which make up the end of the bag 2 are releasably attached to the side support bars 10 when the invention is in the bag 2 position. Such a position is engaged when the back support 17 or leg support 18 is in a position equal to 90° or less with respect to the base support 19. The cover flaps 15 may be releasably attached by any means; such releasable attachment may be made by either the trademarked product Velcro, continuous snaps or even by a zipper device. Such releasable attachment is engaged with side support bars 10. The bottom portion of the cover flaps 15 is permanently affixed to the end portion of the base support 19 by means such as sewing or glue.

Figure 2:
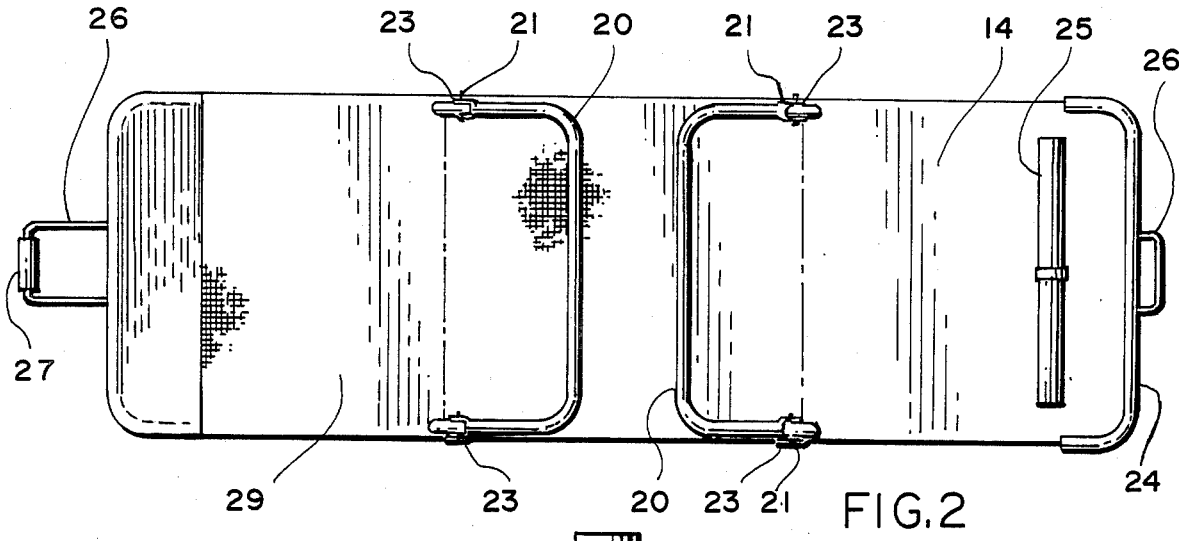
FIG. 2 is a bottom view of the invention without cover flaps showing supports in opposite 180° angulation with the legs folded.
Figure 3:
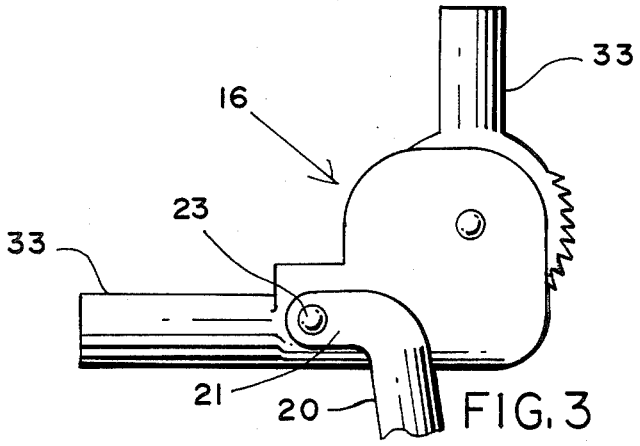
FIG. 3 is a side view of the support hinge.

The legs 20 are attached to the base support bar 12 near the support hinge 16 by a leg hinge 21 as shown in FIG. 2. Such leg hinge 21 affixes the leg 20 to the base support bar 12 by means of a rivet 23 which would allow for movement of the leg 20 into an extended or retracted position. The legs 20 are not covered by the cover material 14.

Additionallly, FIG. 1 shows a leg rest 24 (head rest 22 not shown) attached to the end support bar 11 by conventional means. The head rest 22 and leg rest 24 are provided for comfort to the individual utilizing the lounge chair 1.

Figure 4:
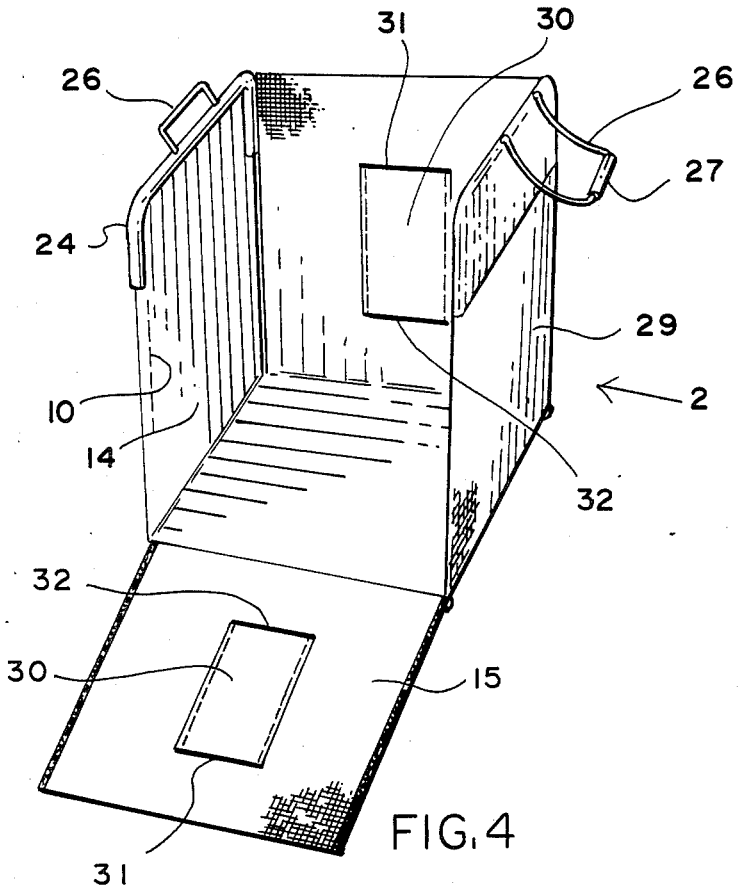
FIG. 4 is a perspective side view without legs of the invention at 90° angles to the base support with one cover flap engaged and the other disengaged.
Figure 5A:
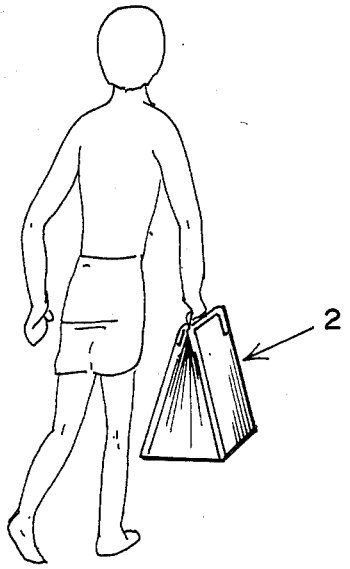
FIGS. 5A and 5B show the carrying positions of the invention in its tote bag form with both cover flaps fully engaged.
Figure 5B:
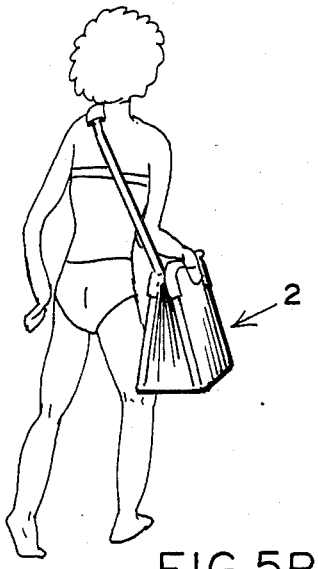

FIG. 4 represents the lounge chair 1 which has been converted into the bag 2 by raising the back support 17 and leg support 18 to a position equal to at least 90° with respect to the base support 19. Thereafter, the cover flaps 15 are releasably attached to the edge of the back support 17 and leg support 18 by conventional means stated above. Handle grips 26 are attached medially to the edge of the back support 17 and the base support 19. One embodiment allows for one of the handle grips 26 to be longer than the other so as to allow the longer grip to be pulled through the shorter grip such that the longer grip may be used to carry the bag 2 by having the longer grip rest on one's shoulder. A shoulder pad 27 is attached to this longer handle grip 26 for comfort. This may be seen on the right side of the individual in FIG. 5B, and generally, FIG. 4. Another handle grip 26 embodiment provides for straps to be permanently affixed on one end each of diametrically opposed ends of the cover material 14 positioned near the end support bar 11 of the back support 17 and leg support 18, and releasably attached at the free end of the handle grip 26 by conventional means.

Preferred embodiments of the invention provide for a large pouch 29 on the exterior of bag 2. Moreover, pockets 30 may be attached to the interior of the cover flaps 15 by permanently affixing the sides of the pockets 30 and releasably fixing the top 31 and bottom 32 of the pockets 30 such that the top 31 of the pocket 30 in the bag 2 position would become the bottom 32 part of the pocket 30 in the lounge chair 1 position. Further, a foot tarpaulin 25 is attached at one end to the exterior of the leg support 18. When the invention is in the lounge chair 1 position, the foot tarpaulin 25 is rolled out thus allowing for a clean footrest.

It is intended that the description of the preferred embodiments of this invention is illustrative only. Other embodiments of the invention that are within the scope and concept of this invention are herein included within this application.

What is claimed is:

1. A convertible three-sectioned lounge chair tote bag comprising, in combination, side support bars, end support bars, wherein said end support bars and said side support bars are grouped such that two side support bars and one end support bar are one continuous piece of metal such that said end support bar and said side support bars are generally perpendicular to one another and form a back support and a leg support, respectively, base support bars, support hinges, such that said support hinges connect said base support bars at one end of said support hinges forming a base support and connect said back and leg support, respectively, at the other end of said support hinges, said support hinges having means to provide multiangular locking positions such that said back and leg supports pivot from a substantially horizontal position to an upright vertical position and disengage to allow repositioning to said horizontal position when said back and leg supports are pivoted to an angle less than 90° to that of the base support, two legs wherein said legs are attached to said base support bars about said support hinges by means of a rivet thus forming leg hinges, a polysynthetic contiguous cover material, such that said cover material is permanently attached about said back support, said leg support, and said base support and having on the edge of said end support bars handle grips attached thereto such that when said back and leg supports are in an upright position and said legs are pivoted to the folded position adjacent to base support, sides of an open-topped tote bag are formed, said cover material having cover flaps such that said cover flaps are permanently attached to said cover material at and around the base support, said cover flaps having a means for being releasably attached at their sides to the edge of said cover material adjacent to the back and leg supports, respectively, when said back support and said leg support are in an upright position thereby forming the sides of a variably sized volumetric capacity open-topped tote bag.

2. In the convertible three-sectioned lounge chair-tote bag of claim 1, said cover material about the exterior of the back support having a pouch comprised of the cover material.

3. In the convertible three sectioned lounge chair-tote bag of claim 1, a foot tarpaulin is permanently attached at one end to said cover material about the exterior of said leg support such that said foot tarpaulin may be fully extended or rolled-up at its free end.

4. In the convertible three-sectioned lounge chair-tote bag of claim 1, the cover flaps having an interior portion, wherein the interior of said cover flaps contain pockets, such that said pockets are permanently attached to said interior of said cover flaps on their lateral sides and releasably attached on their longitudinal sides, said releasable attachment being located at the top and bottom of said pockets.

5. In the convertible three sectioned lounge chair-tote bag of claim 1, said cover material on said end support bars having permanently attached thereto head and leg rests, respectively, wherein said head and leg rests are padded and engage said end support bars and the proximate end portions of said side support bars, respectively.

* * * * *